United States Patent [19]

Prazak, III

[11] Patent Number: 4,672,260

[45] Date of Patent: Jun. 9, 1987

[54] REGISTRATION-ENHANCING MEANS AND METHOD FOR COLOR CATHODE RAY TUBES HAVING THE TENSED FOIL SHADOW MASK

[75] Inventor: Charles J. Prazak, III, Elmhurst, Ill.

[73] Assignee: Zenith Electronics Corporation, Glenview, Ill.

[21] Appl. No.: 754,786

[22] Filed: Jul. 12, 1985

[51] Int. Cl.[4] ..... H01J 29/82; H01J 29/07

[52] U.S. Cl. ..... 313/407; 313/408; 445/37; 445/45

[58] Field of Search ..... 313/402, 407, 408; 445/37, 47, 68, 25, 45

[56] References Cited

U.S. PATENT DOCUMENTS

| | | | |
|---|---|---|---|
| 3,858,284 | 1/1975 | Costa et al. | 445/25 |
| 3,879,629 | 4/1975 | Durant | 445/25 X |
| 4,547,696 | 10/1985 | Strauss | 313/407 |

*Primary Examiner*—Palmer C. DeMeo

*Assistant Examiner*—Sandra L. O'Shea

*Attorney, Agent, or Firm*—Ralph E. Clarke, Jr.

[57] ABSTRACT

A glass faceplate for use in a color cathode ray tube has a target area with a pattern of phosphor deposits circumscribed by a sealing area, and a frame supporting a shadow mask with a sealing area geometrically matching the sealing area of the faceplate. Three indexing means are spaced apart along the sealing areas for indexing the faceplate in relation to the frame, providing a gap of predetermined width, and leaving at least one corner of the faceplate unsupported. Shims means having shimming dimension equivalent to or slightly less than the predetermined gap width is located in the gap at the unsupported corner, whereby the unsupported corner is supported by the shim means such that the predetermined gap width is maintained during tube fabrication even at the unsupported corner. A method for assembling a color cathode ray tube which utilizes the shimming means according to the invention is also disclosed.

7 Claims, 7 Drawing Figures

REGISTRATION-ENHANCING MEANS AND METHOD FOR COLOR CATHODE RAY TUBES HAVING THE TENSED FOIL SHADOW MASK

CROSS-REFERENCE TO RELATED APPLICATIONS

This application is related to but in no way dependent upon copending applications Ser. Nos. 538,001 now U.S. Pat. No. 4,593,224 and 538,003 now abandoned both filed Sept. 30, 1983; Ser. Nos. 572,088 now U.S. Pat. No. 4,547,696 and 572,089 now U.S. Pat. No. 4,595,857 both filed Jan. 18, 1984; and Ser. Nos. 646,861 now U.S. Pat. No. 4,614,892 and 646,862 now U.S. Pat. No. 4,593,225, both filed Aug. 31, 1984; Ser. No. 735,887 filed 5-17-85; Ser. No. 729,020, filed Apr. 30, 1985; Ser. No. 725,040, filed Apr. 19, 1985; Ser. No. 727,486, filed Apr. 26, 1985; Ser. No. 729,015, filed Apr. 29, 1985 and Ser. No. 743,184 filed June 10, 1985 all of common ownership herewith.

BACKGROUND OF THE INVENTION

This invention relates generally to cathode ray picture tubes and is specifically addressed to a novel front end assembly for high-resolution cathode ray tubes having shadow masks of the tensed foil type. The invention has particular utility in enhancing registration of the shadow mask and target area of the faceplate.

A high-resolution color cathode ray tube that utilizes a tensed foil shadow mask typically includes three electron guns arranged in a delta or in-line configuration. Each gun projects an electron beam through the assigned apertures of a shadow mask, also called a "color selection electrode," onto a target area on the inner surface of the faceplate. The target area comprises a pattern of phosphor deposits arranged in groups of triads of dots. Each of the triads consists of a dot of a red-, green-, and blue-light-emitting phosphor. To improve the brightness of the display and to minimize the incidence of color impurities which can result if a beam falls upon an improper phosphor deposit, the target area may include a layer of darkish light-absorbing material called a "grille" that surrounds and separates each of the dots. This type of screen is known as a "matrix" or "black surround" screen. Alternately, the phosphor and grille deposits on the target surface may comprise a plurality of vertically oriented, spaced rectangles in coordinate relationship to apertures in the form of rectangles or "slots" in the shadow mask. Tubes of this type are referred to as "slot mask tubes," in contrast to the "dot screen" types of tubes.

The phosphor pattern, whether dots, or stripes, is typically formed by a direct photoprinting process. The target area is first coated with a photosensitive slurry comprising phosphor particles of one of the three phosphors described. The shadow mask, mounted in a frame, is temporarily installed in precise relationship to the faceplate, and the coating is exposed to actinic light projected through the apertures of the mask from a light source located at a position that corresponds to the beam-emission point of the related electron gun. The faceplate is separated from the shadow mask and the coating is "developed" to remove unexposed portions. The result is a pattern of dots or stripes capable of emitting light of one color, whether red, green or blue. The mask is then re-registered with the faceplate, and the steps are repeated for each of the remaining colors to deposit triads of phosphor deposits on the target area on the faceplate in coordinate relationship with each aperture of the mask. A further step, usually taken before the deposition of the phosphors, is the application of the black surround.

The screening process requires a mechanism whereby the faceplate may be removed and replaced in precise registration with the shadow mask for the black surround and each of the three colors. The conventional "domed" shadow mask, which is mounted on a stiff frame, is made repeatably registrable with the phosphor deposits screened on the faceplate by a suspension system comprising three or four leaf springs. The springs are spot welded to the mask frame at selected points around its periphery. The distal ends of the springs are apertured to engage studs which project inwardly from the rearwardly extending flange of the tube faceplate. Demounting the mask is accomplished by depressing the springs to disengage the studs, and separating the panel from the mask frame, usually by automatic machinery. In the remounting, following the deposition of a phosphor, the mask and faceplate are again brought into propinquity whereby the springs are caused to re-engage the studs. This process does not lend itself to the screening of a tube that utilizes a foil mask (which is the subject of this application) because of the lack of structural strength of the very thin foil and the very different structures used to support it within the bulb. Therefore, a different means of mask-faceplate referencing is required for tension-mask tubes.

A major problem in manufacturing a color tube with a foil-type shadow mask is the difficulty in re-aligning the panel with the mask accurately enough to maintain registration between the mask apertures and the associated phosphor deposits. In this type of mask, there is a need for greater precision in registration. Foil mask thickness is typically about 0.0003 inch, and the diameter of the apertures in a dot screen tube is about 0.0035 inch. The "pitch" (distance between aperture centers; for use in a high-resolution display may be, for example, 0.3 millimeters, and for very high resolution tubes, 0.2 millimeters or 0.15 millimeters or less. With regard to the Q-distance, this measurement is a function of the pitch of the shadow mask. For example, for a given gun design, if the pitch is 0.3 millimeters, the Q-distance may be, by way of example, 0.330 inch. For the very high resolution pitch of 0.2 millimeters, the Q-distance may be about 0.210 inch. These values dictate the need for great precision in the registration and re-registration of the mask and faceplate. For example, a tolerance of $\pm 0.0006$ inch in mask-faceplate registration is acceptable in the manufacture of conventional standard resolution cathode ray tubes having the domed mask. In the manufacture of the high resolution tension mask tubes with which this invention is concerned, however, the allowable tolerance is about $\pm 0.0002$ inch. If this tolerance is exceeded, color purity can be degraded.

Ball-and-groove indexing means have been found to provide the great precision in faceplate-shadow mask registration required in the photoscreening and in the final assembly of color cathode ray tubes that utilize the tensed foil shadow mask. An example of ball-and-groove registration-affording means is disclosed in referent copending application Ser. No. 572,088. Registration-affording ball-and-groove means for this and others of the referent copending applications comprise in essence three radially oriented V-grooves spaced 120 degrees apart and located in the peripheral sealing area of the faceplate. A like plurality of identically oriented V-grooves is located on the sealing area of a frame assembly that supports a tensed foil shadow mask. The indexing means of the registration-affording means comprise a like plurality of balls which ride in the facing grooves when the faceplate and shadow mask-containing frame assembly are brought into mating conjunction. Ball-and-groove means for registration are also disclosed and claimed in other referent copending applications including Ser. Nos. 538,001; 572,088; 572,089; 729,015; 735,887; 727,486 and 743,184, all of common ownership herewith.

OBJECTS OF THE INVENTION

It is a general object of the invention to provide improved performance in color cathode ray tubes that utilize tensed foil shadow masks.

It is a more specific object of the invention to provide means for enhancing color purity in color cathode ray tubes that utilize the tensed foil shadow mask.

It is a specific object of the invention to provide means for enhancing the registration between the apertures of a tensed foil shadow mask and the correlative phosphor deposits photoscreened on the faceplate target area of high-resolution color cathode ray tubes.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
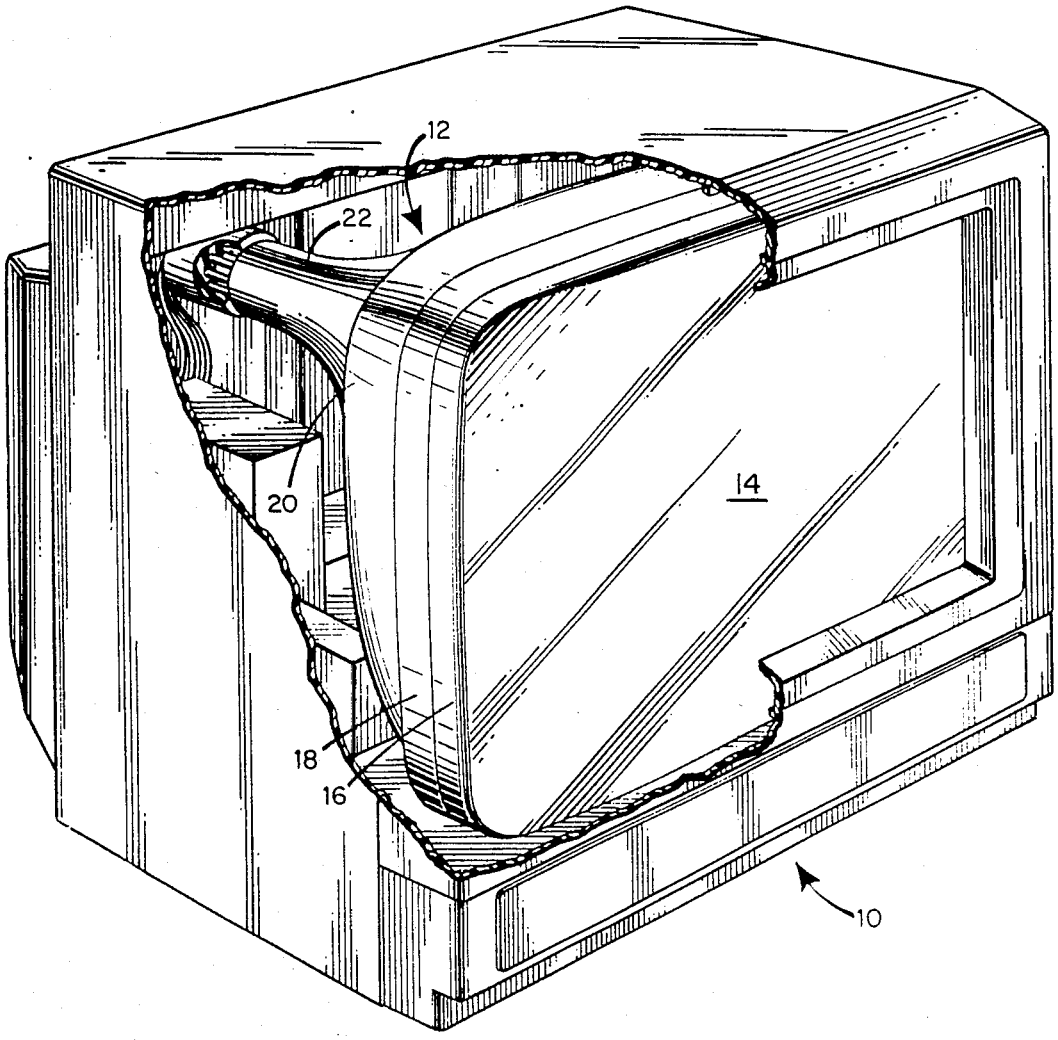
FIG. 1 (PRIOR ART)
FIG. 1 is a cut-away view in perspective of a cabinet that houses a high-resolution color cathode ray tube according to the present invention, showing certain major components of the cathode ray tube.

FIG. 1 shows a novel video monitor 10 that houses a high-resolution color cathode ray tube 12, certain components of which can be manufactured according to the present invention. Various features and improvements of the tube 12 are illustrated and described in the referent copending applications assigned to the assignee of the present invention. The design of the monitor is the subject of copending design patent application Ser. No. 725,040 of common ownership herewith. The monitor, and the associated tube, are notable not only for high resolution, but also for the flat imaging area 14 that makes possible the display of images in undistorted form. Imaging area 14 also offers a more complete picture as the corners are relatively square in comparison with the more rounded corners of the conventional cathode ray tube.

Figure 2:
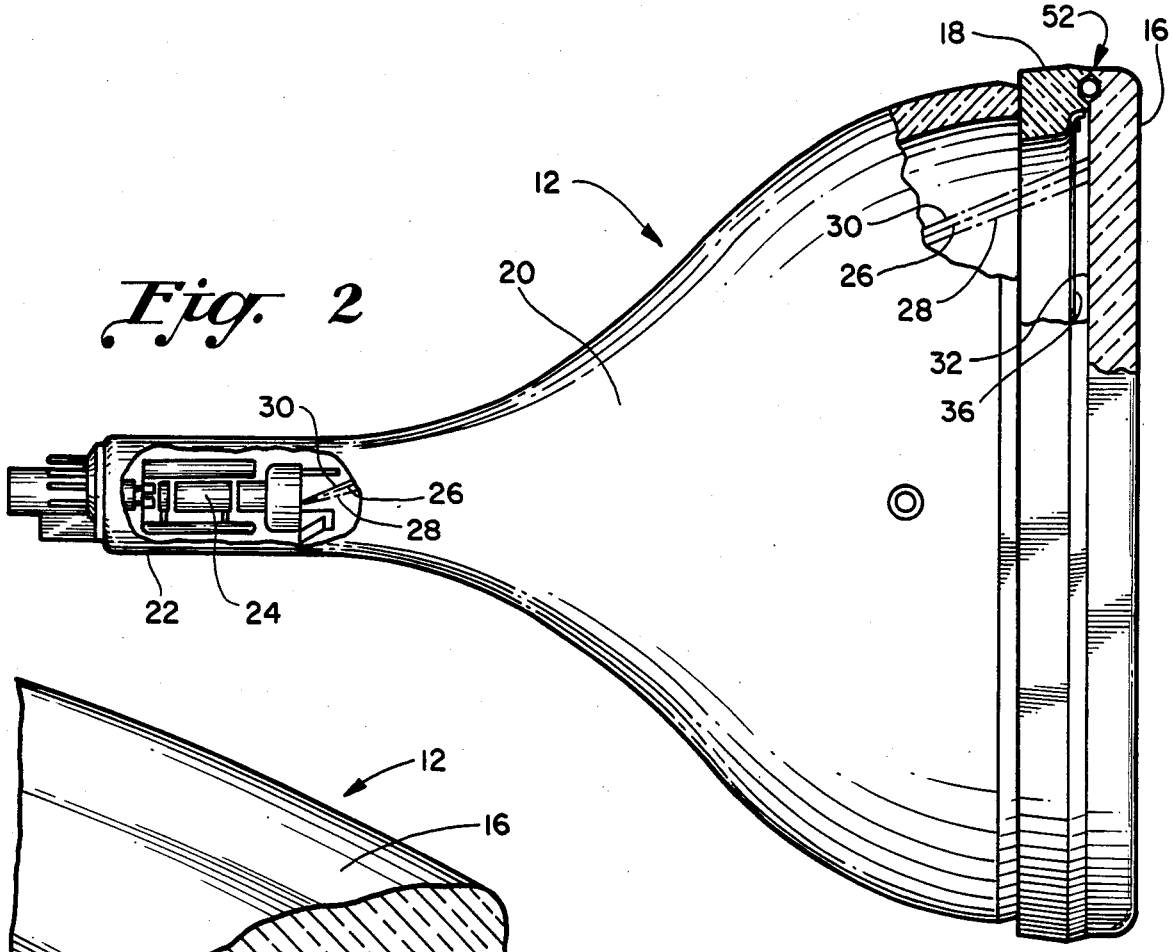
FIG. 2 is a side view in elevation of the color cathode ray tube of FIG. 1 showing another view of the components depicted in FIG. 1 with additional components depicted in cutaway sections.

High-resolution cathode ray tube 12 is shown in FIGS. 1 and 2 as having a flat glass faceplate 16. Faceplate 16 is depicted as being joined to a color selection electrode frame 18 of glass which in turn is joined to a rear envelope section, here shown as a funnel 20 which tapers down to a narrow neck 22. Neck 22 is shown in as enclosing an electron gun 24 which is indicated as projecting three electron beams 26, 28 and 30 onto the inner surface of faceplate 16. The inner surface of faceplate 16 has a target area 32 with a pattern of phosphor deposits (not indicated) circumscribed by a sealing area. The phosphor deposits may comprise triads of red-emitting, green-emitting, and blue-emitting phosphors which emit light when energized by respective ones of the electron beams 26, 28 and 30.

Figure 3:
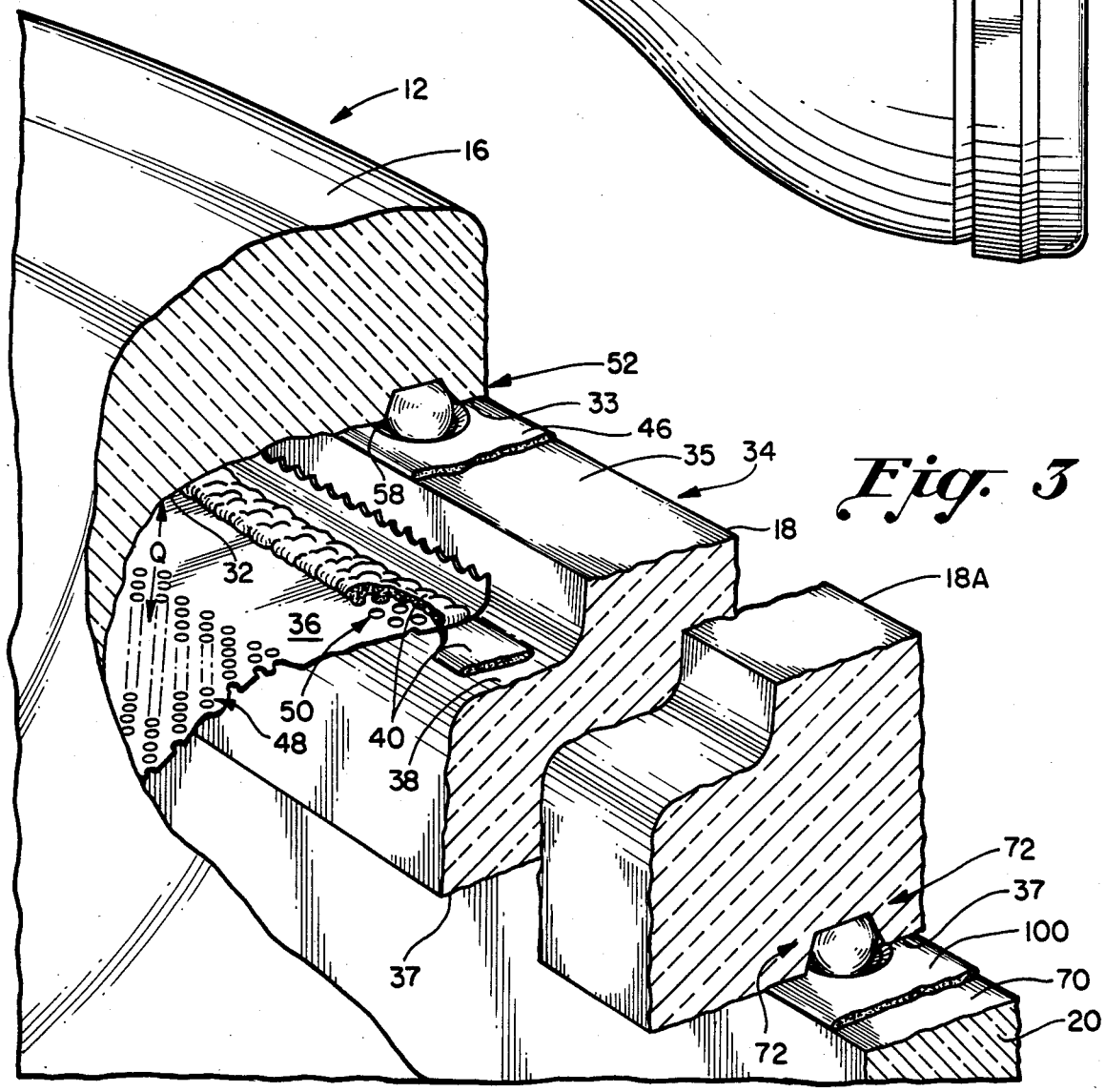
FIG. 3 is an enlarged cut-away exploded view in perspective of a section of the tube of FIG. 2 further showing details of the relationship of the components depicted by FIGS. 1 and 2; a spaced-apart section indicates component relationships.
Figure 4:
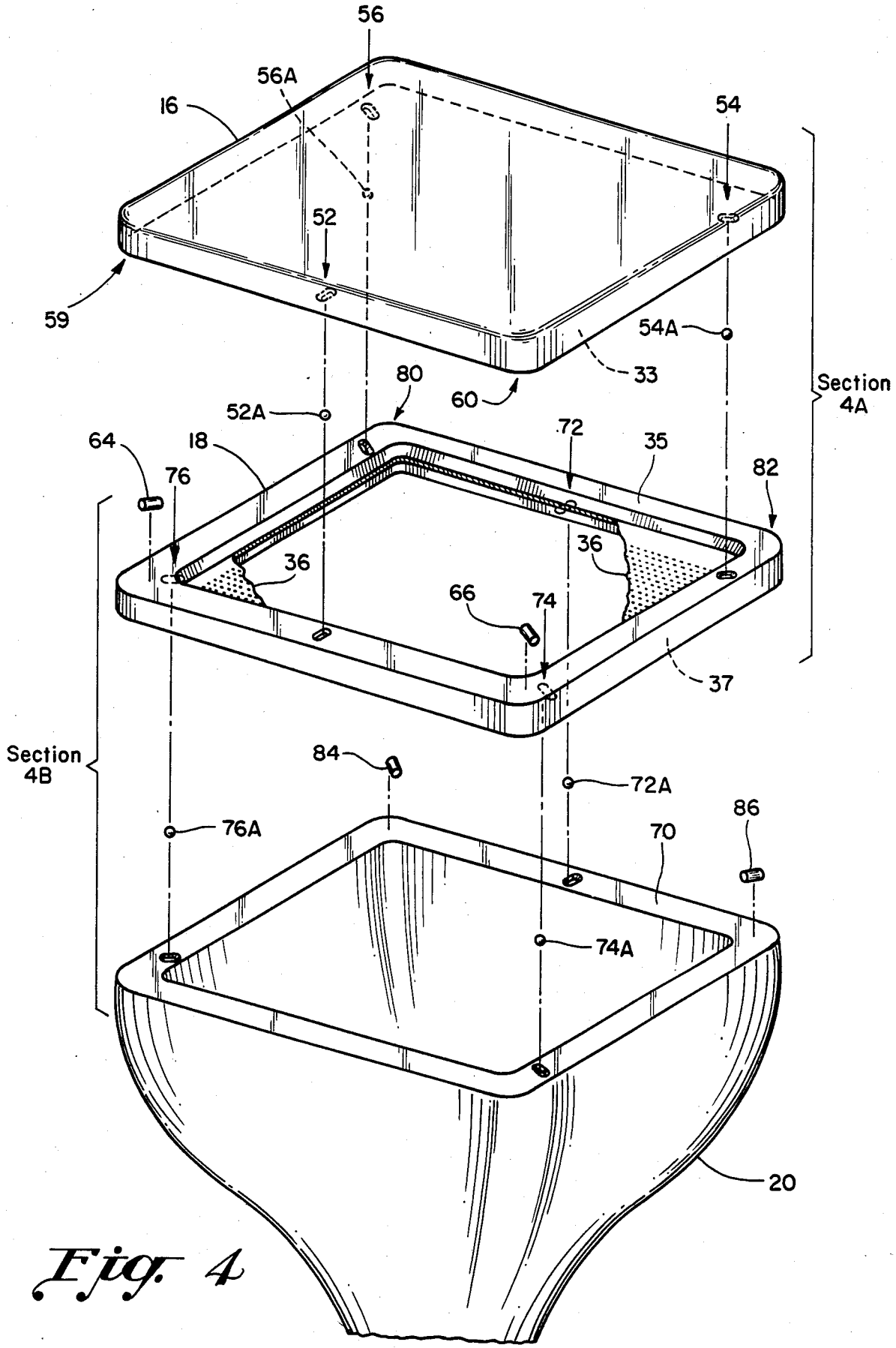
FIG. 4 is an exploded view in perspective depicting the major components of FIG. 3 and showing certain registration-enhancing means according to the invention; Section 4A depicts a faceplate and a shadow mask support frame and their interface, while Section 4B depicts the same frame and a funnel and their interface.

With additional reference to FIGS. 3 and 4, there is shown a color selection electrode assembly 34 which comprises the frame 18 and a shadow mask 36. The frame 18 of assembly 34 supports in tension the thin foil shadow mask 36. The tensed mask 36 is spaced a predetermined "Q" distance from the target area 32 of faceplate 16. The mask will be noted as being flat and parallel with inner surface 32. Frame 18 has first and second plano-parallel spaced apart sealing areas 35 and 37; the first sealing area 35 geometrically matches sealing area 33 of faceplate 16.

FIG. 3 shows the attachment of mask 36 to a peripherally continuous recessed support surface 38 located in frame 18; attachment is indicated as being by means of a layer of cement 40. The sealing area 33 of faceplate 16 is shown as being affixed to the first sealing area 35 on frame 18, also by a layer of cement 46. The cement may be in the form of a devitrifying glass frit such as that supplied by Corning Glass Works of Corning, New York under the designation Glass 7595. A devitrifying frit is compounded as a viscous glass which crystallizes and hardens when heated to a predetermined temperature, and which does not remelt upon reheating so that a permanent bond is made.

Shadow mask 36 is shown as having a first field of apertures 48 therein which provide for color selection in the finished tube, and a second field of apertures 50 peripheral to the first field. Peripheral apertures 50 comprise cement-passing apertures sized to pass cement in its viscous state. The cement can be the heretofore-described devitrifying glass frit. The embodiment of the shadow mask 36 as shown is not the subject of the present application, but is fully described and claimed in referent copending application Ser. No. 729,020.

With additional reference to FIG. 4, Section 4A, three first indexing means 52, 54 and 56 are indicated as being spaced apart along the sealing area 33 of faceplate 16, and the first sealing area 35 of frame 18. Each indexing means will be seen as comprising a groove in the sealing area 33 of the faceplate 16, and a facing groove in the first sealing area 35 of frame 18. When the faceplate and frame are brought together for screening, and in the process of final installation, the respective balls 52A, 54A and 56A of indexing means 52, 54 and 56 lie between and in contact with the respective grooves to provide for registering faceplate 16 with respect to frame 18. The final indexing of faceplate 16 with frame 18 is depicted by FIG. 3 with respect to one of the indexing means, wherein indexing means 52 is shown in place in the condition of final assembly of tube 12.

Figure 5A:
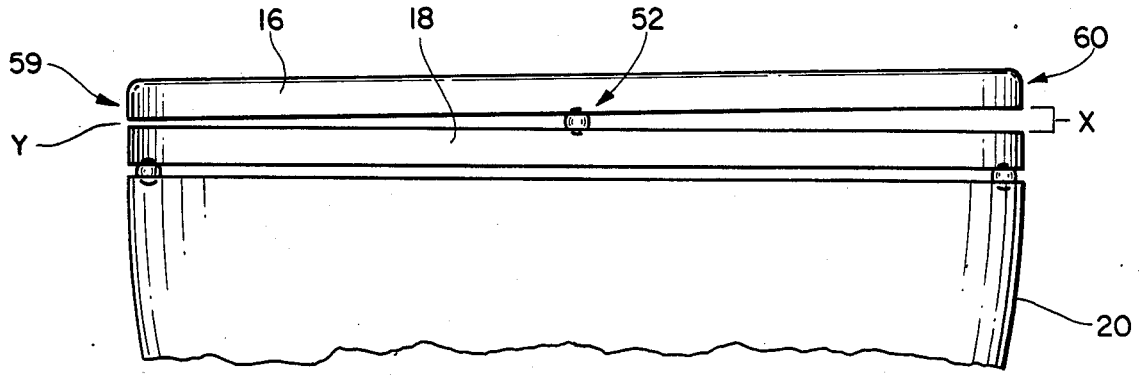
FIG. 5A is a side view in elevation that shows in greatly exaggerated form undesired effects on component configuration under production conditions.
Figure 5B:
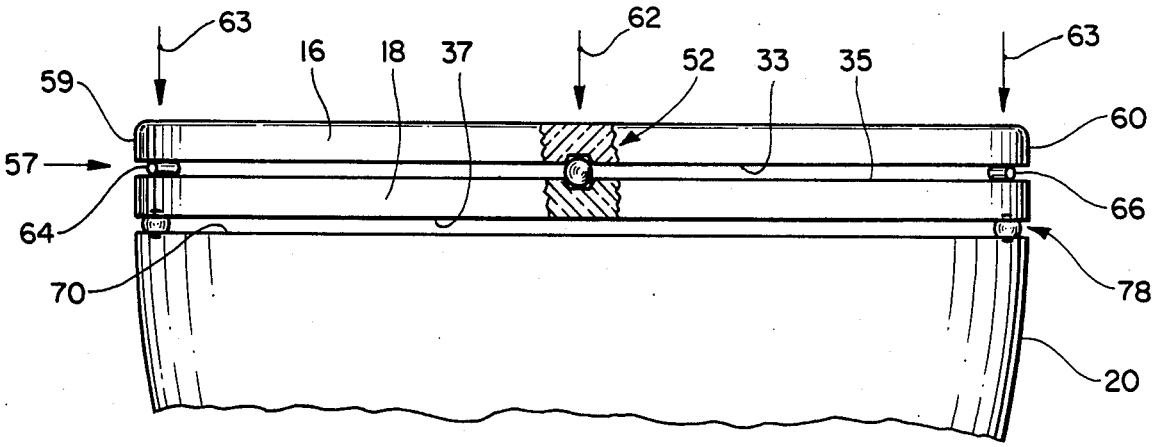
FIG. 5B is a view identical to FIG. 5A showing additional details of registration-enhancing means according to the invention.

First indexing means 52, 54 and 56 are indicated in FIG. 4 as being spaced apart along sealing area 33 of the faceplate 16 and first sealing area 35 of frame 18. When the faceplate 16 and frame 18 are mated by the indexing means, there remains a gap of predetermined width between faceplate and frame; this gap 57 is depicted in FIG. 5B. The gap is necessary for the deposition of the cement that bonds the faceplate and the frame together. The width of the gap 57 is indicated schematically by the thickness of the layer of cement 46 depicted in FIG. 3.

The first indexing means 52, 54 and 56 are so located as to leave at least one corner unsupported. In the illustrated embodiment two corners are unsupported. The two corners, designated as 59 and 60, are shown in FIG. 4 as being intermediate to the indexing means 52 and 56, and 52 and 54, respectively.

In the final production process that follows the screening of the faceplate, the faceplate, frame and funnel are bonded permanently together by means of a cement which is usually a glass frit cement that must be heated to a temperature of about 430 degrees Centigrade in order to become a bonding agent. This temperature provides for devitrification of the frit and air-tight joining at the sealing areas.

During the faceplate screening process, the faceplate 16 is precisely registered with a color selection electrode frame several times by the use of the first indexing means described heretofore. In this screening phase of production, which is done at a normal ambient temperature, the configurations of the faceplate and frame are stable; that is, there is no alteration in planarity, for example. However, when the frit is applied to the screening areas and the components are heated to the temperature at which the frit cement devitrifies and permanent bonding takes place—a temperature noted as being about 430 degrees centigrade—the faceplate may flex about its diagonals to cause a twist-wise deformation. This deformation becomes permanent upon devitrification and setting of the cement. The effect of the deformation is indicated by FIG. 5A, wherein the width of the gap at "x" is shown to be much greater than the gap "y" located at the opposite ends of the faceplate 16 and frame 18.

The consequence of the permanent twist-wise deformation of the faceplate and/or the frame are color impurities in the areas of the unsupported corners—a condition that is highly undesirable in color tubes of the high-resolution type according to the invention. It is notable that a deflection of a corner of as little as two or three mils can result in color impurities.

Because of the nature of glass and its basic nonuniformity, the width of the gap at each unsupported corner must be measured and the proper shim means having a dimension adequate to support the corner, must be selected. The gap width at one unsupported corner may be as much as 15 mils by way of example (gap width "x" in FIG. 5A), while the gap width at the opposite unsupported corner may be 9 mils (gap width "y"). Preferably, and according to the invention, the shim means may comprise glass rods having a diameter equivalent to or slightly less than the shimming dimension as measured. For example, if the gap is measured as being 15 mils; in this case a 15 mil rod or a 14 mil rod may be selected. Using a rod of 14 mils ensures that the indexing means will seat properly, and the difference is so slight as to not affect mask-target registration to any perceptible extent. Additionally, and according to the invention, if glass rods are used, they may have a color differing from the color of the associated parts for easy perception during the production process.

Shim means 64 and 66 according to the invention are shown schematically in FIG. 4, Section 4A, and in FIG. 5B, as being located at unsupported corners 59 and 60 in the gap between the faceplate 16 and frame 18. As per the foregoing example, shim means 64 may have a diameter of 9 (or 8) mils to fill the measured gap, while shim means 66 may have a diameter of 15 (or 14) mils to fill the measured gap. Thus the shims 64 and 66 maintain the gap width as it existed during the faceplate screening phase; that is, when the faceplate 16 and frame 18 are "cold" and undistorted by the heat of the production process. In maintaining the proper and established gap width, the faceplate is prevented from assuming a twist-wise deformation due to the heating of the assembly during the frit-bonding cycle.

The proper gap width and proper registration of the faceplate to frame and frame to funnel is further ensured by means of selective application of pressure to the faceplate. Following the application of cement to the sealing areas between the faceplate 16 and frame 18, and frame 18 and funnel 20, it is necessary to exert pressure on faceplate against frame 18 to seat the balls 52A, 54A and 56A in the grooves of first indexing means 52, 54 and 56 (and to seat the balls in the grooves of a second indexing means as will be described). The impediment to proper seating of the balls is the presence of the cement in its viscous form which may be, as noted, a devitrifying frit cement. It is notable that the balls will seat properly in the absence of cement during the faceplate screening process, and will provide the required precision in mask-target area registration, but proper seating will not take place in the presence of viscous cement unless pressure is applied to the faceplate. The necessary ball-seating pressure can be supplied by means of the fixture shown by FIG. 6, the operation of which is explained infra.

The ball seating pressure is indicated in FIG. 5B by the arrow 62, shown as applying pressure directly upon the faceplate over the first indexing means 52. Similar pressure is applied to indexing means 54 and 56 (not shown in this Figure). At the same time pressure is applied to the faceplate over the indexing means 52, 54 and 56, pressure is also applied on the faceplate directly over the shims 64 and 66, as indicated by arrows 63. By means of this pressure, which may be approximately 12 pounds by way of example, the gap width between the faceplate and the frame is maintained during the high-temperature fritting operation at precisely the same width as it was during the "cold" faceplate screening process. Further, the pressure is maintained upon the indexing means during the high-temperature frit cement cycle to prevent the glass of any component from deforming to the extent that faceplate-mask misregistration will occur, with consequent color impurities in the display.

Funnel 20 is indicated as having a sealing area 70 which geometrically matches the second sealing area 37 of frame 18. Three indexing means 72, 74 and 76 are shown in FIG. 4, Section 4B being spaced apart along sealing area 70 of funnel 20 and second sealing area 37 of frame 18. As with the first indexing means 52, 54 and 56, each indexing means consist of grooves in the respecting sealing areas 37 and 70, with associated balls 72A, 74A and 76A therebetween. Indexing means 72, 74 and 76 will be noted as being azimuthally rotated with respect to the first indexing means 52, 54 and 56 to lie about midway between ones of the first indexing means. The second indexing means provide for indexing the frame 18 with the funnel 20, and provide a gap 78 between frame 18 and funnel 20 of predetermined width. Second indexing means are so located as to leave corner sections 80 and 82 of frame 18 intermediate to the second indexing means unsupported. As with shim means 64 and 66, shim means 84 and 86 according to the invention have shimming dimensions eqivalent to or slightly less than the predetermined gap width between frame 18 and funnel 20, and are located in the gap 78 at the unsupported corners 80 and 82 of frame 18.

As a result, and in accordance with the invention, the unsupported corner sections 59 and 60 of faceplate 16 with respect to frame 18, and the unsupported corner sections 80 and 82 of frame 18 with respect to funnel 20, are supported by respective shim means 64 and 66, and 84 and 86, such that the predetermined width at gaps 57 and 78 are maintained during tube fabrication even at the respective unsupported corner sections 59 and 60, and 80 and 82.

Figure 6:
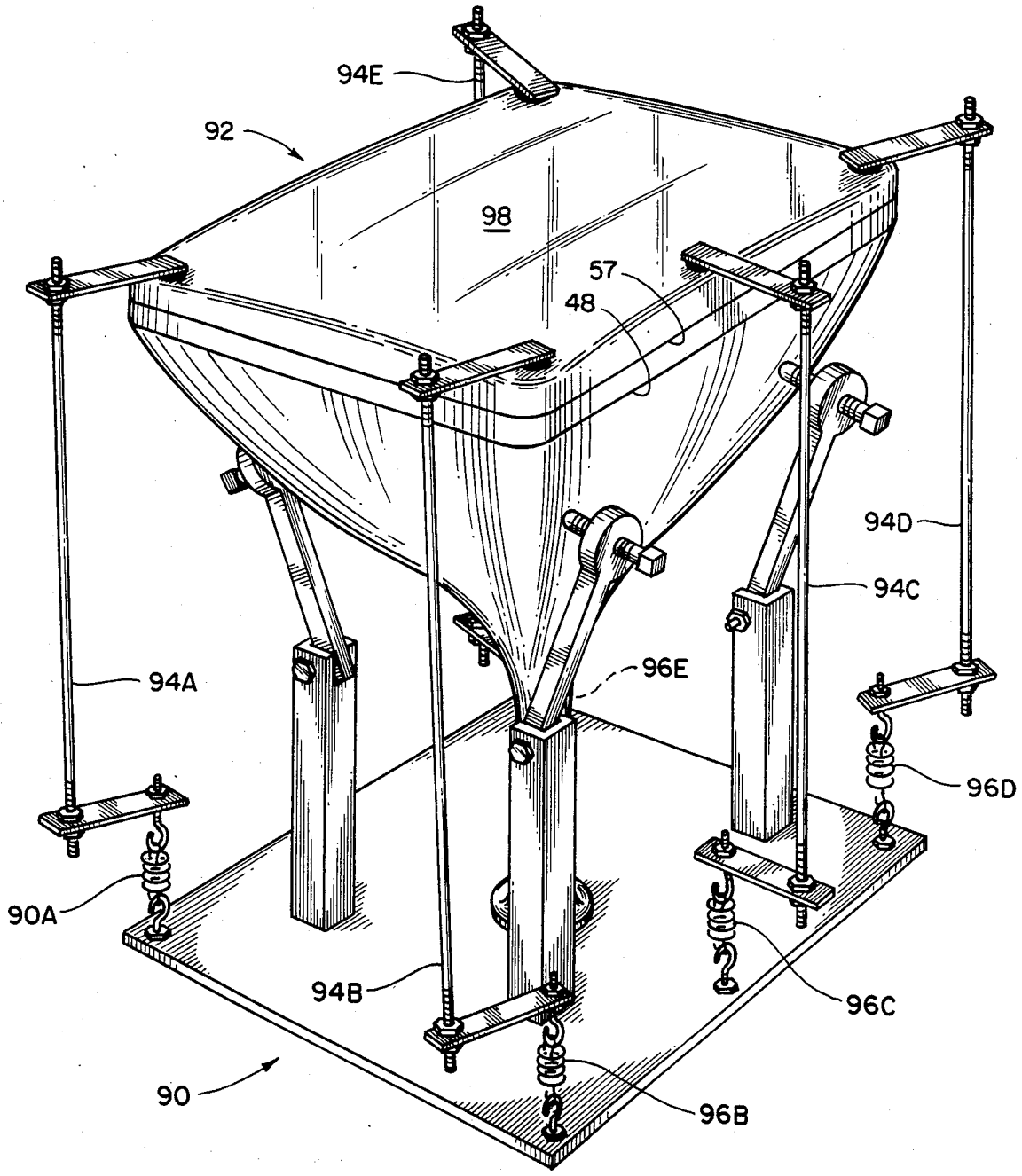
FIG. 6 is an oblique view in perspective of a fixture for clamping tube envelope components during a production process.

The necessary pressure for properly registering the balls of the indexing means during cementing of the faceplate to the frame, and the frame to the funnel, in final tube assembly, can be applied by the fixture 90 shown by FIG. 6. An assembled cathode ray tube 92 is depicted as being mounted in fixture 90. The tube 92 is in a condition such that cement in viscous form has been applied to the heretofore described gaps 57 and 78 between, respectively, the faceplate and frame, and the frame and the funnel. The first and second indexing means 52 and 72, also described supra, are in position to provide precise registration of the faceplate to the frame and the frame to the funnel. Five spring clamp means 94A–E of L-configuration are indicated as applying pressure by means of the associated springs 96A–E, against the surface of faceplate 98. According to the inventive method, pressure is exerted on faceplate 98 against the frame, and concurrently on the funnel, primarily over the indexing means and the shim-supported corners while the cement is caused to set.

A method according to the invention for the manufacture of a color cathode ray tube having a foil mask in tension, and wherein one corner of the faceplate is unsupported, comprises the following. (The components are as heretofore described; that is, a faceplate, a frame supporting a shadow mask and three indexing means spaced along the sealing areas.)

The method comprises:

inserting at the gap at the unsupported corner a shim having a shimming dimension equivalent to or slightly less than the gap width;

applying a cement in viscous form along the sealing areas;

installing the faceplate on the frame, and registering the faceplate with respect to the frame by the indexing means;

exerting pressure on the faceplate against the frame primarily over the indexing means and the shim-supported corners while the cement is caused to set.

A method for the manufacture of a color cathode ray tube having a foil mask in tension, and wherein corner sections of the faceplate and frame are unsupported, comprises the following. (The components are as heretofore described; that is, a faceplate, a frame supporting a shadow mask, a funnel, and indexing means for indexing the faceplate to the frame and frame to the funnel.)

The method comprises:

inserting in the gaps at the unsupported corners shim means having shimming dimensions equivalent to or slightly less than the gap widths;

applying a cement in viscous form along the sealing areas;

installing the frame on the funnel, and the faceplate on the frame, and registering the funnel, frame and faceplate by the indexing means;

exerting pressure on the faceplate against the frame, and concurrently on the funnel, primarily over the indexing means and the shim-supported corners while the cement is caused to set.

The tube as finally assembled is depicted in FIG. 3, where it is shown that faceplate 16 is in permanent attachment to the frame 18 by means of a layer of cement 46, with the precise registration having been supplied by the first indexing means 52 (along with 54 and 56 which are also not shown in this view), now inert as to any further function. Similarly, frame 18 is in permanent attachment to funnel 20 by means of a layer of cement 100, with the precise frame-to-funnel registration having been supplied by second indexing means 72 (along with 74 and 76 which are not shown in this view). The section 18A of frame 18 is broken away to indicate that second indexing means 72, 74 and 76 are azimuthally rotated with respect to the first indexing means 52, 54 and 56 to lie about midway between ones of the first indexing means.

While a particular embodiment of the invention has been shown and described, it will be apparent to those skilled in the art that changes and modifications may be made in the inventive means and method without departing from the invention in its broader aspects. For example, in an application of the invention in a system wherein three indexing means might be located at the corners of the faceplate and the fourth corner is floating, shimming means according to the invention may be located in the fourth corner. The aim of the appended claims therefore is to cover all such changes and modifications as fall within the true spirit and scope of the invention.

I claim:

1. For use in a color cathode ray tube, the combination comprising:

a glass faceplate having a target area with a pattern of phosphor deposits circumscribed by a sealing area;

a frame supporting a shadow mask and having a sealing area geometrically matching said sealing area of said faceplate;

three indexing means spaced apart along said sealing areas indexing said faceplate in relation to said frame, and providing a gap between said faceplate and said frame of predetermined width, said indexing means being so located as to leave at least one corner of said faceplate unsupported;

shims means having a shimming dimension equivalent to or slightly less than said predetermined gap width and located in the gap at said unsupported corner;

whereby said unsupported corner of said faceplate is supported by said shim means such that said predetermined gap width is maintained during tube fabrication even at said unsupported corner.

2. The color cathode ray tube according to claim 1 wherein said shim means comprises a glass rod having a diameter equivalent to or slightly less than said shimming dimension.

3. The color cathode ray tube according to claim 2 wherein said glass rod has a color differing from the color of said faceplate for easy perception during tube production.

4. For use in a color cathode ray tube, the combination comprising:

a glass faceplate having a target area with a pattern of phosphor deposits circumscribed by a sealing area;

a frame supporting a tensed shadow mask and having a sealing area geometrically matching said sealing area of said faceplate;

three indexing means spaced apart along said sealing areas for indexing said faceplate in relation to said frame, and providing a gap between said faceplate and said frame of predetermined gap width width, said indexing means being so located as to leave two corners of said faceplate unsupported;

two shim means having shimming dimensions equivalent to or slightly less than said predetermined gap width and located in the gap at said unsupported corners;

whereby said unsupported corners of said faceplate are supported by said shim means such that said predetermined gap width is maintained during tube fabrication even at said unsupported corners.

5. For use in a color cathode ray tube, the combination comprising:

a glass faceplate having a target area with a pattern of phosphor deposits circumscribed by a sealing area;

a glass frame supporting a tensed shadow mask having first and second plano-parallel spaced-apart sealing areas, said first sealing area geometrically matching said sealing area of said faceplate;

three first indexing means spaced apart along said sealing areas for indexing said faceplate in relation to said frame, and providing a gap between said faceplate and said frame of predetermined gap width, said first indexing means being so located as to leave corner sections of said faceplate intermediate to said first indexing means unsupported;

two shim means having shimming dimensions equivalent to or slightly less than said predetermined gap width and located in the gap at said unsupported corner sections of said faceplate;

a funnel having a sealing area geometrically matching said second sealing area of said frame;

three second indexing means spaced apart along said sealing area of said funnel and said second sealing area of said frame and azimuthally rotated with respect to said first indexing means to lie about midway between ones of said first indexing means, said second indexing means providing for indexing said frame with respect to said funnel, said second indexing means providing a gap between said frame and said funnel of predetermined gap width, said second indexing means being so located as to leave corner sections of said frame intermediate to said second indexing means unsupported;

shims means having shimming dimensions equivalent to or slightly less than the predetermined gap width between said frame and said funnel, and located in the gap at the unsupported corner sections of said frame;

whereby the unsupported corner sections of said faceplate with respect to said frame, and said corner sections of said frame with respect to said funnel, are supported by said shim means such that said predetermined widths of said gaps are maintained during tube fabrication even at the unsupported corner sections.

6. A method for use in the manufacture of a color cathode ray tube, the tube including:

a glass faceplate having a target area with at least one pattern of phosphor deposits circumscribed by a sealing area;

a frame supporting a foil shadow mask in tension and having a sealing area geometrically matching said sealing area of said faceplate;

three indexing means spaced apart along said sealing areas for registering said faceplate in relation to said frame, and providing a gap between said faceplate and said frame of predetermined width, said indexing means being so located as to leave at least one corner of said faceplate unsupported;

the method comprising:

inserting at said gap at said unsupported corner a shim having a shimming dimension equivalent to or slightly less than said gap width;

applying a cement in viscous form along said sealing areas;

installing said faceplate on said frame and registering said faceplate with respect to said frame by said indexing means;

exerting pressure on said faceplate against said frame primarily over said indexing means and said shim-supported corner while said cement is caused to set.

7. A method for use in the manufacture of a color cathode ray tube, the tube including:

a glass faceplate having a target area with at least one pattern of phosphor deposits circumscribed by a sealing area;

a glass frame supporting a foil shadow mask in tension and having first and second plano-parallel spaced-apart sealing areas, said first a sealing area geometrically matching said sealing area of said faceplate;

three indexing means spaced apart along said sealing area of said faceplate and said first sealing area of said frame for indexing said faceplate with respect to said frame, and providing a gap between said faceplate and said frame of predetermined gap width, said indexing means being so located as to leave corner sections of said faceplate unsupported;

a funnel having a sealing area geometrically matching said second sealing area of said support frame;

three second indexing means spaced apart along said sealing area of said funnel and said second sealing area of said frame and azimuthally rotated with respect to said first indexing means to lie about midway between ones of said first indexing means, said second indexing means providing for indexing said funnel with respect to said frame, and providing a gap between said frame and said funnel of predetermined uniform width, said second indexing means being so located as to leave corner sections of said frame intermediate to said second indexing means unsupported;

the method comprising:

inserting in said gaps at said unsupported corners shim means having shimming dimensions equivalent to or slightly less less than said gap widths;

applying a cement in viscous form along said sealing areas;

installing said frame on said funnel, and said faceplate on said frame, and registering said funnel, frame and faceplate by said indexing means;

exerting pressure on said faceplate against said frame, and concurrently on said funnel, primarily over said indexing means and said shim-supported corners while said cement is caused to set.

* * * * *